US006563066B1

(12) United States Patent
Abroy

(10) Patent No.: US 6,563,066 B1
(45) Date of Patent: May 13, 2003

(54) SWITCH MECHANISM HOUSING

(75) Inventor: Hamid S. Abroy, Lexington, KY (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 10/040,698

(22) Filed: Nov. 15, 2001

(51) Int. Cl.[7] ..... H01H 1/64
(52) U.S. Cl. ..... 200/293; 200/294
(58) Field of Search ..... 200/293, 294, 200/303, 307, 33 B, 38 R, 400, 401, 402, 405, 431, 436, 437, 441, 442, 564, 573, 574

(56) References Cited

U.S. PATENT DOCUMENTS 5,737,195 A * 4/1998 Cassity et al. ..... 200/293
5,777,283 A * 7/1998 Greer ..... 200/18
6,313,416 B1 * 11/2001 Abroy et al. ..... 200/15

* cited by examiner

*Primary Examiner*—Elvin Enad
*Assistant Examiner*—Lisa Klaus
(74) *Attorney, Agent, or Firm*—David R. Stacey; Larry I. Golden; Larry T. Shrout

(57) ABSTRACT

An apparatus for housing and securing a switch operating mechanism. The switch mechanism housing includes a housing member with an integral pivot bushing, a housing cover, an operating mechanism including a push rod assembly, a rotor cam, and mechanism shaft. The operating mechanism is installed and fixed in the housing member. The housing member holds captive the operating mechanism without requiring that the housing cover be in place, thereby facilitating fabrication and assembly.

8 Claims, 2 Drawing Sheets

SWITCH MECHANISM HOUSING

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

FIELD OF INVENTION

This invention pertains generally to electrical switch mechanisms. More particularly, this invention pertains to a switch mechanism housing that holds captive a spring loaded push rod.

BRIEF SUMMARY OF THE INVENTION

An apparatus for housing and securing a switch operating mechanism is provided. The apparatus includes a housing member with an integral push rod bushing, a housing cover, and an operating mechanism including a push rod assembly, a rotor cam, and mechanism shaft. The operating mechanism can be installed and fixed in the housing member without the housing cover installed.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
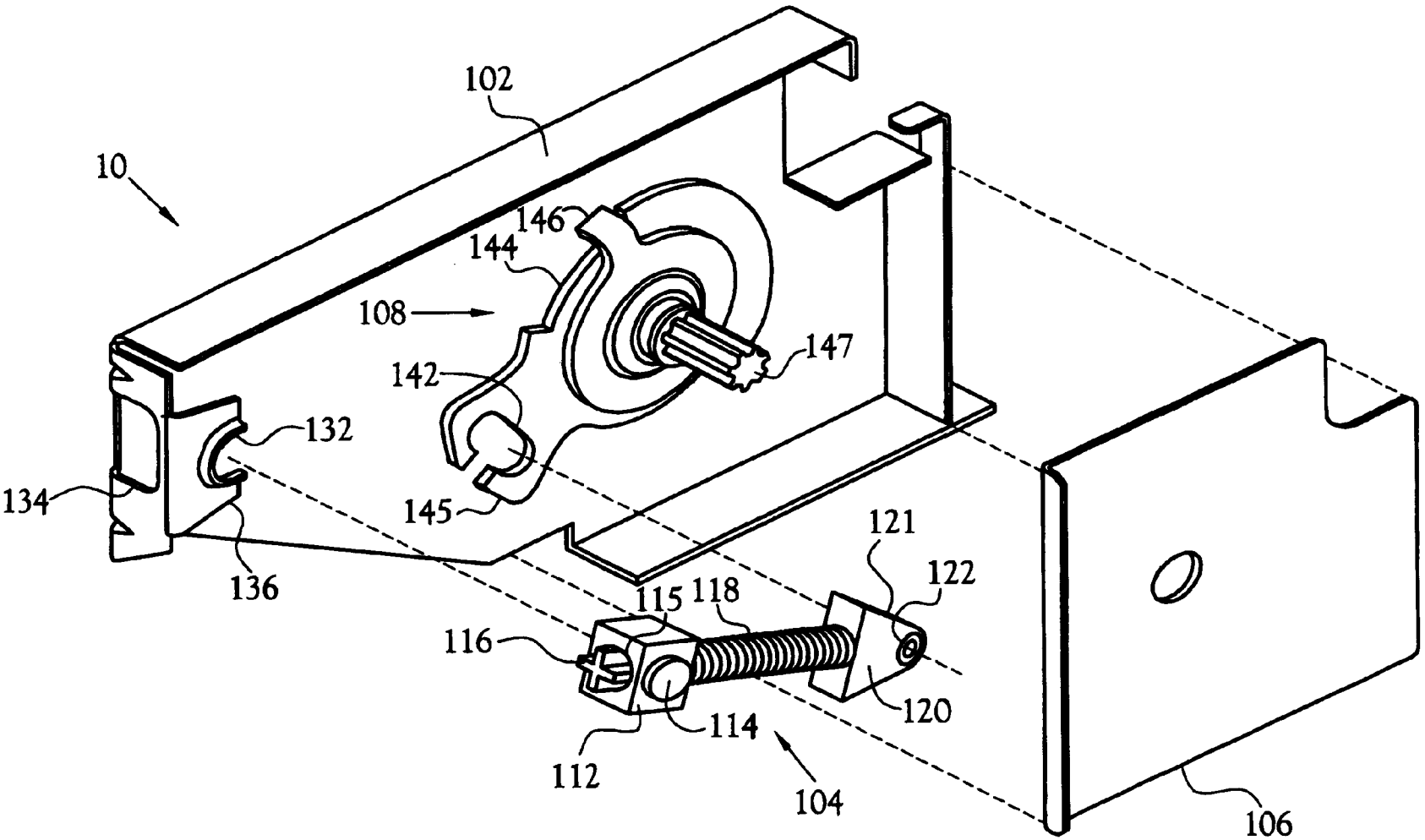
FIG. 1 is an exploded view of a switch mechanism housing.

A switch mechanism housing 10 configured for containing and operatively securing a switch operating mechanism 108 is disclosed. FIG. 1 illustrates a switch mechanism housing 10 such as can be used in any switch requiring a biased, over-center, bi-stable rotary operating mechanism. Those skilled in the art will recognize that the present invention is not limited to switch mechanism housings having the illustrated configuration.

FIG. 1 illustrates an exploded view of the switch mechanism housing 10, including a one piece housing member 102, a push rod assembly 104, a bistable rotary assembly 108, and a housing cover 106. The rotary assembly 108 includes an operator cam rotor 144 and a handle cam 146 that rotate between bistable positions about a mechanism shaft 147. Those skilled in the art will recognize that the details and features of the rotary assembly 108 can vary without departing from the spirit and scope of the present invention.

The push rod assembly 104 includes a push rod pivot 112, a pushrod shaft 116, an operator spring 118, and a push rod head 120 at one end of the pushrod shaft 116. The push rod pivot 112 has a pivot shaft 114 extending from opposite sides of the push rod pivot 112 and an opening 115 for slidably receiving the end of the push rod shaft 116 opposite the head 120. The push rod head 120 has a slot 121 that receives a portion 145 of the cam rotor 144 defining an arcuate slot 142. A transverse member 122, generally perpendicular to the axis of the slot 121 in the push rod head 120, is received within and engages the arcuate slot 142. Movement of the rotary assembly 108 from one of its bistable positions causes the push rod assembly 104 to pivot about the push rod pivot 112. As the push rod assembly 104 pivots in response to rotation of the rotary assembly 108, the push rod shaft 116 extends into the opening 115 of the push rod pivot 112, thereby compressing and energizing the operator spring 118. After the traverse member 122 of the head 120 crosses the mid-point of the arcuate slot 142, the operator spring 118 decompresses and accelerates the head 120 and transverse member 122 to the opposite side of the arcuate slot 142, causing the rotary assembly 108 to snap to its other bistable position.

The housing member 102 includes a pivot bushing, or curved slot, 132 and a coaxially aligned elongated opening, or aperture, 202 (illustrated in FIG. 2), which receive the pivot shaft 114 of the push rod pivot 112. The housing member 102 also includes a push rod shaft opening, or aperture, 134, through which the push rod shaft 116 passes as the operator spring 118 is compressed and decompressed. The housing cover 106 attaches to the housing member 102, and covers the rotary assembly 108, but, in the illustrated embodiment, not the push rod pivot 112. The configuration of the switch mechanism housing 10 is such that the housing member 102, the rotary assembly 108, and the push rod assembly 104 can be assembled as a unit before the housing cover 106 is attached to the housing member 102. The push rod assembly 104 is held captive by the rotary assembly 108 at one end and by the pivot bushing 132 and the opening 202 at the other end, thereby facilitating fabrication and assembly of the switch mechanism housing 10.

Figure 2:
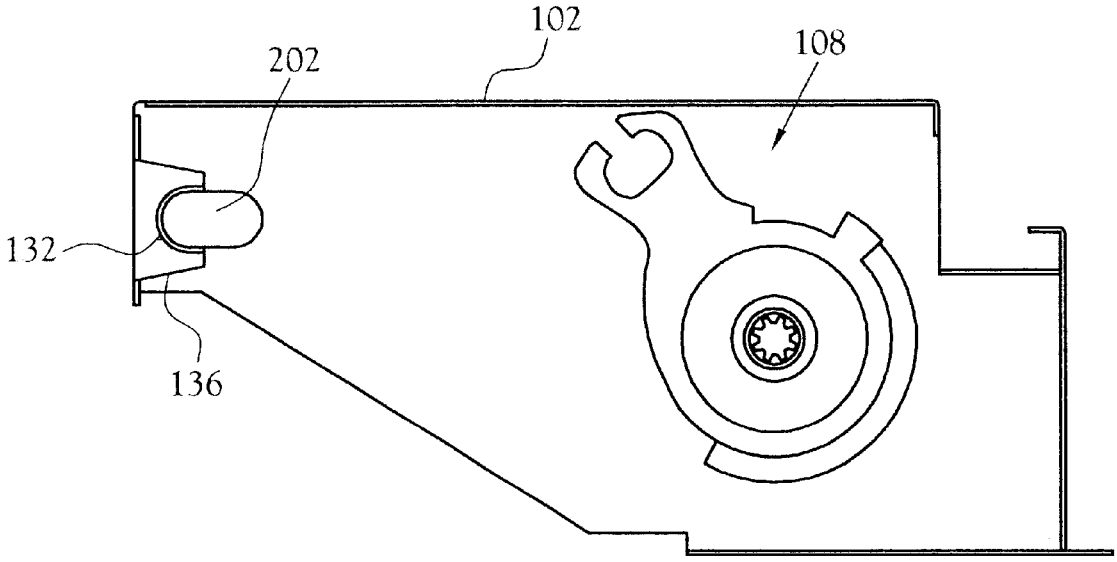
FIG. 2 is a plan view of a switch housing mechanism without the housing cover and push rod.

FIG. 2 illustrates the housing member 102 and the rotary assembly 108, without the push rod assembly 104. The pivot bushing, or curved slot, 132 and the elongated opening, or aperture, 202 for receiving the pivot shaft 114 are shown. The pivot bushing 132 is a semi-circular opening or slot formed in a lip 136 of the housing member 102, and the pivot bushing 132 is aligned with the coincident portion of the elongated opening 202. In the illustrated embodiment, the housing member 102 is formed of sheet metal that has been bent to the illustrated shape and configuration. In the illustrated embodiment, the pivot bushing 132 has a bearing surface formed by bending the housing member 102 sheet metal, resulting in the bearing surface being thicker than the housing member 102 thickness. Those skilled in the art will recognize that such an enlarged bearing surface is not be necessary when the housing member 102 sheet metal thickness is sufficient to provide a bearing surface for the pivot shaft 114. The elongated opening 202 in the housing member 102 permits the pivot shaft 114 of the push rod pivot 112 and the push rod assembly 104 to be easily rotated into its assembled position.

Figure 3:
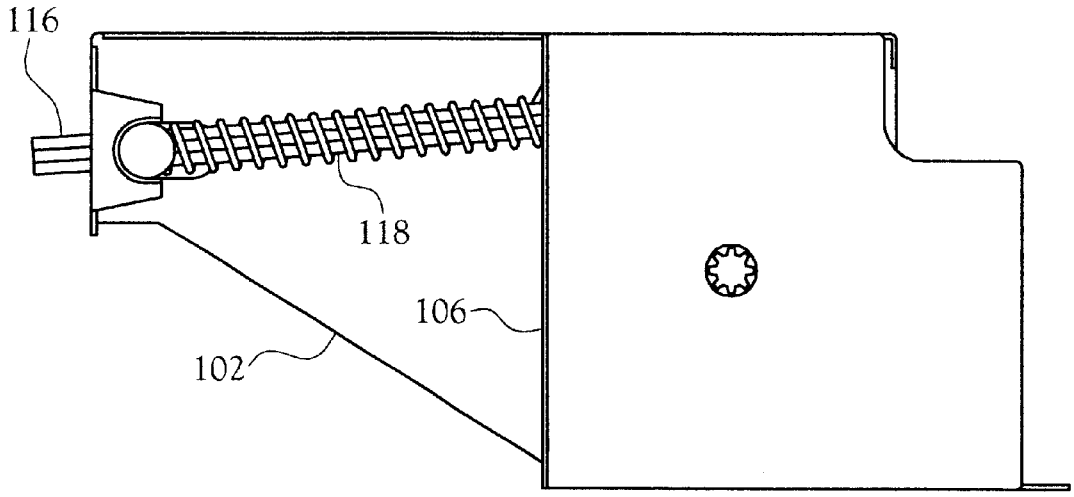
FIG. 3 is a plan view of a switch housing mechanism with the housing cover installed.

FIG. 3 illustrates an assembled switch mechanism housing 10. The push rod assembly 104 is shown with the rotary assembly 108 in its most clockwise position. During operation, the push rod shaft 116 reciprocates through the shaft opening 134. The housing cover 106 covers the central portion of the rotary assembly 108.

From the foregoing description, it will be recognized by those skilled in the art that an apparatus for housing and securing a switch operating mechanism has been provided. The switch mechanism housing holds captive a push rod without requiring that the cover be in place, thereby facilitating fabrication and assembly.

While the illustrative embodiments of the present invention have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus, and illustrative examples shown and described. Accordingly, departures may be made from such details without departing from the spirit or scope of applicant's general inventive concept.

Having thus described the aforementioned invention, I claim:

1. An apparatus for securing an elongated push rod assembly, including a pivoting end and an opposed operator cam rotor engaging end, within a housing member, prior to the attachment of a housing cover to said housing member, in a position of engagement with an operator cam rotor secured to said housing member, said operator cam rotor including an engagement slot, comprising:

an aperture defined in said housing member; and a curved slot defined in said housing member and coaxially aligned with said aperture, said pivoting end of said push rod assembly being pivotably mounted within said aperture and said curved slot, and said operator cam rotor engaging end being pivotably engaged with said operator cam rotor engagement slot.

2. A housing for securing a switch operating mechanism, said switch operating mechanism including a push rod assembly, a rotor cam, and a mechanism shaft, said push rod assembly having a first end connected to said rotor cam and a second end having a pivot shaft, said housing comprising:

a housing member adapted to contain said switch operating mechanism;

a pivot bushing formed in said housing member, said pivot bushing having an open end adapted to mate with said pivot shaft of said push rod assembly; and an opening in said housing member, said opening opposite said pivot bushing and adapted to mate with said pivot shaft of said push rod assembly, wherein said pivot shaft of said push rod assembly pivots at said pivot bushing and said opening.

3. The housing of claim 2 further comprising a housing cover adapted to mate with a portion of said housing member enclosing said mechanism shaft.

4. The housing of claim 2 wherein said push rod assembly is captive in said housing member.

5. A housing for securing a switch operating mechanism, said switch operating mechanism including a push rod assembly, a rotor cam, and a mechanism shaft, said push rod assembly having a first end connected to said rotor cam and a second end having a pivot shaft, said housing comprising:

a housing member adapted contain said switch operating mechanism;

a pivot member having a pivot bushing formed in said housing member and an opposing opening in said housing member, said pivot member-adapted to mate with said pivot shaft of said push rod assembly.

6. The housing of claim 5 further comprising a housing cover adapted to mate with a portion of said housing member.

7. A housing for securing a switch operating mechanism, said switch operating mechanism including a push rod assembly, a rotor cam, and a mechanism shaft, said push rod assembly having a first end connected to said rotor cam and a second end having a pivot shaft, said housing comprising:

a housing member adapted to contain said switch operating mechanism;

a means for pivoting said push rod assembly; and a means for holding captive said push rod assembly in said housing member.

8. The housing of claim 7 further comprising a means for covering a portion of said housing member.

* * * * *